US005372318A

United States Patent [19]

Jacobson

[11] Patent Number: 5,372,318

[45] Date of Patent: Dec. 13, 1994

[54] RETENTION AND POSITIONING DEVICE FOR HIGH ENERGY ABSORBING PADS

[75] Inventor: Charles R. Jacobson, Greendale, Wis.

[73] Assignee: Nordberg Inc., Milwaukee, Wis.

[21] Appl. No.: 73,794

[22] Filed: Jun. 8, 1993

[51] Int. Cl.[5] ..... B02C 02/04

[52] U.S. Cl. ..... 241/207; 241/285.1; 241/290

[58] Field of Search ..... 241/DIG. 30, 207, 214, 241/215, 285.1, 286, 290; 248/638, 637; 267/293, 153, 141.1, 140

[56] References Cited

U.S. PATENT DOCUMENTS 2,180,278 11/1939 Ellis .
2,555,064 5/1951 Stevens et al. .
2,675,968 4/1954 Dunbar .
3,103,348 9/1963 Paulsen ..... 267/141.1
4,452,401 6/1984 Zarogatsky et al. ..... 241/207
4,478,373 10/1984 Gieschen ..... 241/285.1
4,512,525 4/1985 Cameron ..... 241/207
4,579,290 4/1986 Terrenzio ..... 241/285.1
4,773,604 9/1988 Johnson .
4,787,562 11/1988 Templeton .
5,158,269 10/1992 Hein et al. ..... 267/141.1
5,242,146 9/1993 Tecco et al. ..... 267/141.1

*Primary Examiner*—Timothy V. Eley
*Attorney, Agent, or Firm*—Greer, Burns & Crain

[57] ABSTRACT

A retention and positioning device is disclosed for a crusher having a main frame with an upper seat, and an upper frame held in releasably biased relation to the main frame and including a portion engaging the upper seat during normal operation. The retaining and positioning device includes a bracket constructed and arranged for retention upon the upper seat during operation of the crusher, the bracket defining at least one pad aperture, and at least one shock absorbing pad configured for retention in each aperture. During operation of the crusher, when the upper frame is momentarily displaced from engagement with the main frame, the return of the upper frame to the upper seat is cushioned by the at least one pad.

19 Claims, 2 Drawing Sheets

RETENTION AND POSITIONING DEVICE FOR HIGH ENERGY ABSORBING PADS

BACKGROUND OF THE INVENTION

The present invention relates generally to mineral comminution devices, and particularly to conical rock crushers in which an upper frame is held in releasably biased relationship against a fixed main frame.

Conical type rock crushers of the type contemplated for use with the present retention and positioning device include a fixed main frame enclosing a gyrating conical head. The gyrating head defines a lower crushing surface. An upper frame or bowl is held in releasably biased relationship against an upper seat of the main frame, usually by a plurality of coiled springs, fluid power cylinders, or a combination of the two. The bowl includes a bowl liner which defines a normally fixed upper crushing surface. Incoming mineral material is fed between the upper and lower crushing surfaces where it is reduced to a specified size or smaller. Such a crusher is disclosed in commonly-assigned U.S. Pat. No. 4,478,373, which is incorporated by reference herein.

During operation, the bowl is maintained in a biased, contacting relationship to the upper seat, however, in a process known as tramp release, the bowl may lift upon the introduction of uncrushable matter or tramp material with the feed material. Once the tramp material has been passed, the bowl returns to contact the upper seat, usually with a forceful impact which causes high localized stresses, and may in some cases result in damage and failure to the upper seat area or corresponding regions of the bowl.

Attempts at lessening the stresses generated by the shock of the reseating bowl have typically involved the insertion of shock absorbing material between the upper seat and the bowl. One such attempt is disclosed in U.S. Pat. No. 4,773,604, wherein the main frame has a separate upper seat provided with a plurality of annular grooves. A like plurality of rings of resilient material are inserted into the grooves and retained there by compression. The resilient rings are dimensioned to project above the surface of the upper seat and thus form a shock absorbent cushion for the bowl.

However, a significant drawback of such an arrangement is that in some cases, the resilient inserts are not adequately retained within the grooves, and may have the tendency to dislodge during operation. In addition, the shock absorbing material of which the inserts are made has the tendency to collapse or migrate due to the extreme forces generated by the bowl returning to its normal operating position. Another design consideration of such a system is that the machining of the annular grooves may enhance the stress loading on the upper seat caused by the impacting bowl.

Thus, a main object of the present invention is to provide an effective system for absorbing shock generated by the bowl returning to the upper seat.

Another object of the present invention is to provide an upper seat protective device which employs resilient, shock absorbing material in a manner wherein any migration and/or flow of the resilient material under the extreme shock loading generated during crusher operation is accommodated.

Yet another object of the present invention is to provide a shock absorbing system for the upper seat of a conical crusher, which may be readily adapted to existing crushers in the field.

SUMMARY OF THE INVENTION

Accordingly, the above-listed objects are met or exceeded by the present retention and positioning device, in which a pad retaining bracket is loosely disposed upon the upper seat. The bracket has at least one pad retaining aperture wherein a shock absorbing pad is loosely retained to accommodate the migration and/or flow of the material caused by shock loading generated by the bowl returning to its normal operating position.

More specifically, the present retention and positioning device is intended for use in a crusher having a main frame with an upper seat, and an upper frame held in releasably biased relation to the main frame. The upper frame includes a portion engaging the upper seat during normal operation. The present retaining and positioning device includes a bracket constructed and arranged for retention upon the upper seat during operation of the crusher. The bracket defines at least one pad aperture, and at least one shock absorbing pad configured for retention in each aperture, so that during operation of the crusher, when the upper frame is momentarily displaced from engagement with the main frame, the return of the upper frame to the upper seat is cushioned by the at least one pad.

A feature of the present retention and positioning device is that the bracket and pads are retained in a relatively loose orientation to accommodate the significant shock loading inherent with conical crushers, without causing damage to the pads or the retaining bracket. Further, the present device does not impair the structural integrity of the upper seat.

DESCRIPTION OF THE PREFERRED EMBODIMENT

Figure 2:
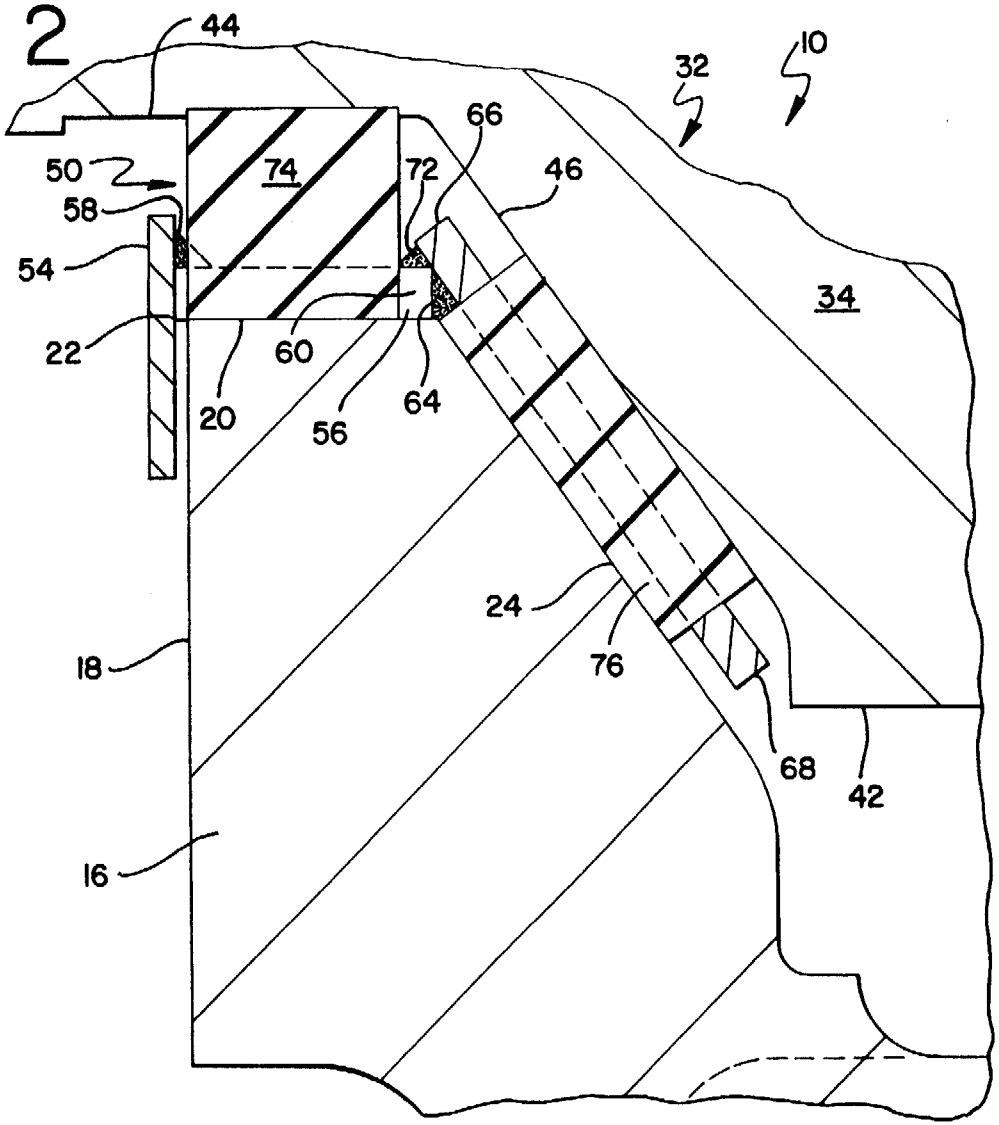
FIG. 2 is an enlarged vertical sectional view of the present retention and positioning device depicted in FIG. 1.
Figure 1:
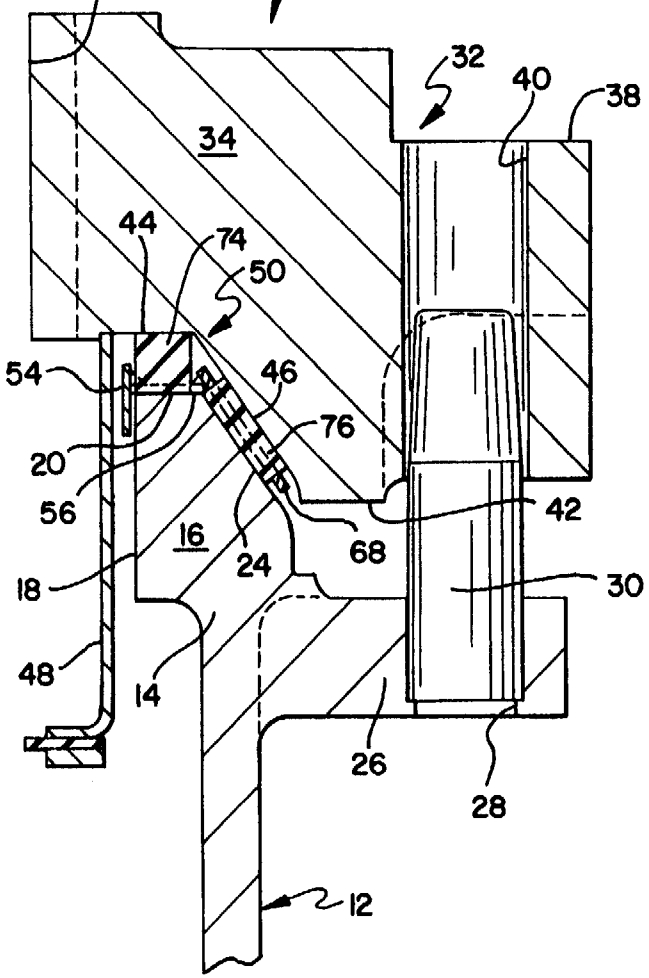
FIG. 1 is a partial vertical section of a conical crusher equipped with the present retention and positioning device.

Referring now to FIGS. 1 and 2, a conical crusher is shown fragmentarily and is generally designated 10. The illustrated portion of the crusher is fairly typical of conventional conical crushers, and a representative crusher is disclosed in greater detail in commonly assigned U.S. Pat. No. 4,478,373, which is incorporated by reference. The crusher 10 includes a fixed main frame 12 in the shape of an annular shell having an upper edge 14 to which is integrally formed an upper seat 16.

In the preferred embodiment, the upper seat 16 includes a generally vertical inner face 18, a generally horizontal top surface 20 intersecting the inner face along an inner edge 22 (best seen in FIG. 2), and a beveled outer face 24. It is contemplated that the present retaining and positioning device may also be used with crushers having upper seats in which only the inner face is beveled, and/or where both the inner and outer faces are beveled. The main frame 12 also includes at least one radially projecting flange member 26 having a generally vertically projecting aperture 28 into which is inserted and secured a main frame locating pin 30. The pin 30 is preferably tapered at its upper end to facilitate engagement with the upper frame.

The crusher 10 also includes an upper frame or bowl generally designated 32, which includes an annular adjustment ring 34. A helically threaded inner face 36 is provided on the adjustment ring 34 for engaging like threads of a bowl member (not shown) to adjust the crusher setting, or the position of the bowl relative to the gyrating conical head (not shown) as is well known in the art. A peripheral edge portion 38 of the adjustment ring 34 is provided with a generally vertical locating bore 40 dimensioned to slidingly accommodate the locating pin 30.

A lower surface 42 of the adjustment ring 34 includes a generally horizontal portion 44 which generally parallels the top surface 20, and a declining portion 46 which generally parallels the beveled face 24. In conventional crushers, during normal operation, the adjustment ring 34 engages the upper seat 16. More specifically, the top surface 20 engages the horizontal portion 44 and the beveled face 24 engages the declining portion 46. In the preferred embodiment, the adjustment ring 34 is provided with a depending annular dust collar 48.

Referring now to FIGS. 1–4, the present retention and positioning device is generally designated 50 and includes a bracket 52 constructed and arranged for loose disposition and retention on the upper seat 16. The bracket 52 includes a generally vertically disposed retaining ring 54 dimensioned to engage and circumscribe the vertical inner face 18 and the inner edge 22 of the upper seat 16.

A first annular pad retention ring 56 is secured along an inner edge to the retaining ring 54, as by welding or other suitable means, and may be supported by gussets 58 or other conventional support formations. In the preferred embodiment, the first pad retention ring 56 rests upon the top surface 20 of the upper seat 16 (best seen in FIG. 2). The first pad retention ring 56 is preferably defined by a plurality of flat, arcuately spaced blocks 60 secured at an inner edge to the retention ring 56. A first plurality of pad retention apertures 62 are defined by the areas between adjacent blocks 60.

Outer edges 64 of the blocks 60 are fastened, as by welding, to an inner edge 66 of a radially displaced second pad retention ring 68. The second pad retention ring 68 is mounted to the first ring 56 at a generally declining angle relative to the horizontal and substantially parallels the beveled face 24. Second ring 68 is basically a flat ring of steel into which is cut at least one, and most preferably a second plurality of arcuately spaced pad apertures 70. If desired, support for the junction of the second ring 68 and the blocks 60 may be provided by a gusset 72 or other conventional support formation.

In the preferred embodiment, the pad apertures 70 of the second ring 68 are generally aligned with the pad apertures 62 of the first ring. However, it is contemplated that the respective rows of pad apertures may alternately be staggered somewhat.

Figure 3:
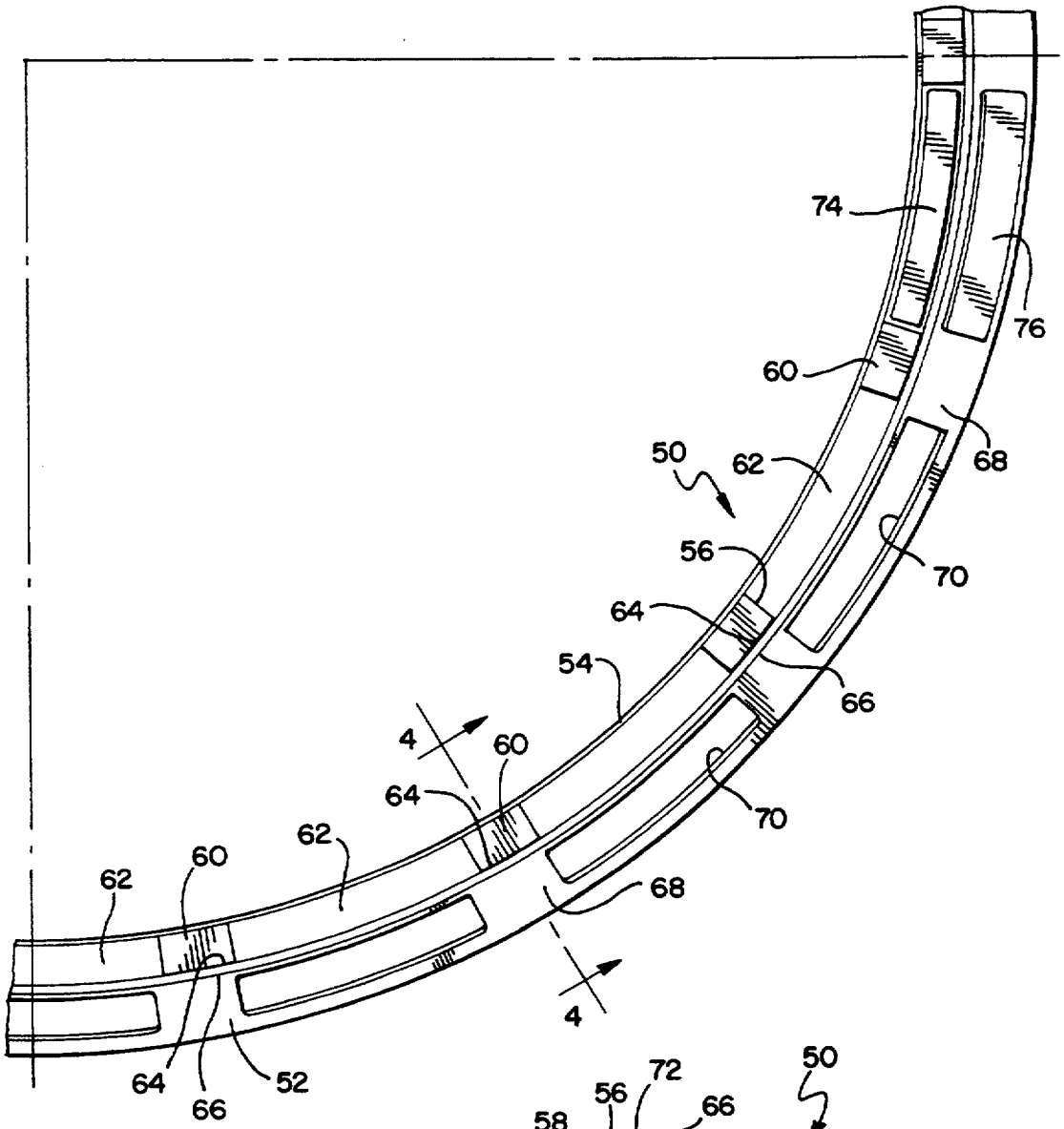
FIG. 3 is a partial overhead plan view of the retention and positioning device depicted in FIG. 1.
Figure 4:
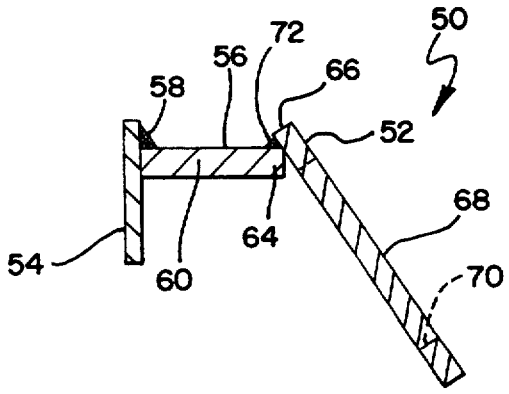
FIG. 4 is a sectional view taken along the line 4—4 of FIG. 3 and in the direction indicated generally.

Referring now to FIGS. 2 and 3, a first shock absorbing pad 74 is loosely disposed in each of the pad apertures 62. Each of the set or plurality of pads 74 is fabricated of a resilient, shock absorptive material, the hardness of which will vary depending on the application. Crusher size, the type of rock crushed, and the condition of the feed material, as well as other factors may all effect the selection of the hardness of the pad 74 to varying degrees. In shape, each of the pads 74 is preferably basically square in cross-section and are dimensioned to fit within the aperture 62 and to bridge any gap between the top surface 20 of the upper seat 16, and the horizontal portion 44 of the lower adjustment ring surface 42 when the crusher 10 is in its normal operating condition as depicted in FIG. 2.

A second shock absorbing pad 76 is dimensioned to be loosely positioned in each of the second pad apertures 70. Compared to the pads 74, the pads 76 in this second set or plurality are basically rectangular in cross-section, and are manufactured of a similar resilient material as are the pads 74. Also, in the preferred embodiment, the pads 74 of the first pad retention ring 56 have a height which is greater than the height of the pads 76 of the second pad retention ring 68.

The pads 76 are dimensioned to be interposed between the beveled outer face 24 of the upper seat 16, and the declining portion 46 of the lower adjustment ring surface 42 when the crusher 10 is in the normal operating position. It will be evident from FIG. 2 that the second pad retention ring 68 is mounted to the bracket 52 to be generally equidistant between opposing portions of the upper seat 16 and the adjustment ring 34.

In operation, the bracket 52 is positioned upon the upper seat 16 during assembly of the crusher or when the bowl 32 is in a vertically raised position, such as is accomplished by hydraulic jacks or lifting cylinders (not shown) which are well known in the art for clearing the crusher. The bracket 52 is merely placed on the upper seat 16, and the retaining ring 54 maintains the position of the bracket during crusher operation. Although a loose disposition of the bracket 52 is preferred, it is contemplated that in some cases the bracket may be fixed to the upper seat 16 or to another portion of the main frame 12. Next, the first shock absorbing pads 74 are loosely placed in the pad apertures 62, and the second shock absorbing pads 76 are loosely placed in the pad apertures 70.

During operation of the crusher 10, when the bowl or upper frame 32 is momentarily displaced from engagement with the main frame 12, the return of the upper frame to the upper seat 16 is cushioned by at least one of the first and second shock absorbing pads, 74, 76. Preferably, the shock is absorbed by a combination of several pads of each type disposed about the upper seat 16, since the circumferential amount of the upper frame 32 which is vertically displaced at any one time due to tramp material is highly variable. The loose disposition of the pads 74, 76 in the bracket 52 allows for shock induced flow and/or migration of the pad material without destroying the pads. Further, the loose mounting of the bracket 52 upon the upper seat 16 also contributes to longer pad life, and makes the device 50 easily adaptable to crushers operating in the field.

While a particular embodiment of the retention and positioning device for high energy crusher frame absorbing pads of the invention has been shown and described, it will be appreciated by those skilled in the art that changes and modifications may be made thereto without departing from the invention in its broader aspects and as set forth in the following claims.

What is claimed is:

1. A retention and positioning device for a crusher having a main frame with an upper seat, and an upper frame held in releasably biased relation to the main frame and including a portion configured for engaging the upper seat during normal operation, said retaining and positioning device comprising:

bracket means constructed and arranged for retention upon the upper seat, said bracket means including a retaining ring and a first pad retention ring secured to said retaining ring and having a corresponding plurality of spaced pad apertures;

at least one shock absorbing pad configured for retention in each said aperture, so that during operation of the crusher, when the upper frame is momentarily displaced from engagement with the main frame, the return of the upper frame to the upper seat is cushioned by said at least one pad.

2. The device as defined in claim 1 wherein said bracket means is constructed to be loosely retained upon the upper seat during crusher operation.

3. The device as defined in claim 1 wherein said retaining ring is a generally vertically disposed band dimensioned to circumscribe an inner edge of the upper seat.

4. The device as defined in claim 1 wherein said bracket means further includes a second pad retention ring having a second plurality of pad apertures and secured to said first ring in radially displaced relation.

5. The device as defined in claim 4 wherein said second pad retention ring is disposed at a declining angle relative to said first ring.

6. The device as defined in claim 4 wherein said pad apertures of said second ring are generally aligned with said apertures of said first ring.

7. The device as defined in claim 4 further including a first plurality of said at least one pad for disposition in said first plurality of pad apertures, and a second plurality of said at least one pad for disposition in said second plurality of pad apertures, wherein each of said first plurality of pads is substantially square in cross-section, and has a height which is greater than the height of each pad of said second plurality of pads.

8. The device as defined in claim 7 wherein said pads of said second plurality of pads are generally rectangular in cross-section.

9. The device as defined in claim 4 further including first support means on said bracket means for supporting a junction of said second pad retention ring and said first pad retention ring.

10. The device as defined in claim 9 wherein said first support means includes gussets adjoining said second ring and said first ring.

11. The device as defined in claim 9 further including second support means on said bracket means for supporting a junction of said retaining ring and said first pad retaining ring of pad apertures.

12. The device as defined in claim 11 wherein said second support means includes gussets adjoining said first ring and said retaining ring.

13. A retention and positioning device for a crusher having main frame with an annular upper beveled seat, and an upper frame held in releasably biased relation to the main frame and including a surface configured for engaging the upper seat during normal operation, said retention and positioning device comprising:

a pad retaining bracket constructed and arranged for loose disposition upon the upper seat during operation of the crusher, said bracket defining at least one set of pad apertures and including a retaining ring for engaging an inner edge of the seat; and at least one shock absorbing pad configured for loose retention in each said aperture, so that during operation of the crusher, when the upper frame is momentarily displaced from engagement with the main frame, the return of the upper frame to the upper seat is cushioned by said at least one pad and said bracket accommodates shock induced flow of said at least one pad.

14. The device as defined in claim 13 wherein said bracket includes a retaining ring dimensioned to generally circumscribe an inner edge of said upper seat, a first pad retention ring having at least one pad aperture and being fastened to said retaining ring, and a second pad retention ring having at least one pad apertures and being fastened to said first pad retention ring.

15. The device as defined in claim 14 wherein said second pad retention ring is disposed at a declining angle relative to said first ring.

16. A conical crusher, comprising:

a main frame with an upper seat;

an upper frame held in releasably biased relation to said main frame and including a portion configured for engaging the upper seat during normal operation;

a retaining and positioning bracket constructed and arranged for retention upon the upper seat during operation of the crusher, said bracket defining at least one pad aperture;

at least one shock absorbing pad configured for retention in each said aperture, so that during operation of the crusher, when the upper frame is momentarily displaced from engagement with the main frame, the return of the upper frame to the upper seat is cushioned by said at least one pad.

17. The crusher as defined in claim 16 wherein said bracket includes a retaining ring and a first pad retention ring having a first plurality of said at least one pad aperture and secured to said retaining ring, each said pad aperture being arcuately spaced from each other.

18. The crusher as defined in claim 17 wherein said retaining ring is a generally vertically disposed band dimensioned to circumscribe an inner edge of the upper seat.

19. The crusher as defined in claim 17 wherein said bracket further includes a second pad retention ring having a second plurality of pad apertures and being secured to said first ring, said second ring being disposed at a declining angle relative to said first ring.

* * * * *